United States Patent [19]

Maeda et al.

[11] Patent Number: 4,841,944

[45] Date of Patent: Jun. 27, 1989

[54] INGITION SYSTEM

[76] Inventors: Tsutomu Maeda; Kiyoshi Matsui; Takayuki Kanno; Kunihiro Sato, all of c/o TDK Corporation 13-1, Nihonbashi 1-chome, Chuo-ku, Tokyo, Japan

[21] Appl. No.: 211,183

[22] Filed: Jun. 24, 1988

[30] Foreign Application Priority Data

Jun. 30, 1987 [JP] Japan ..... 62-100102[U]
Jul. 1, 1987 [JP] Japan ..... 62-101708[U]

[51] Int. Cl.[4] ..... F02D 1/00

[52] U.S. Cl. ..... 123/647; 123/143 B; 123/620; 123/634

[58] Field of Search ..... 123/647, 633, 630, 634, 123/635, 595, 605, 613, 143 B, 596, 606, 653, 620

[56] References Cited

U.S. PATENT DOCUMENTS

| | | | |
|---|---|---|---|
| 3,792,694 | 2/1974 | Branbolts | 123/647 |
| 3,935,852 | 2/1976 | Donovan et al. | 123/647 |
| 4,172,439 | 10/1979 | Daibrig | 123/634 |
| 4,369,758 | 1/1983 | Endo | 123/620 |
| 4,418,660 | 12/1983 | Endo et al. | 123/143 B |
| 4,514,712 | 4/1985 | McDougan | 123/634 |
| 4,617,907 | 10/1986 | Johansson et al. | 123/647 |
| 4,637,368 | 1/1987 | Gillbrand et al. | 123/647 |
| 4,665,922 | 5/1987 | Gillbrand et al. | 123/647 |

FOREIGN PATENT DOCUMENTS

| | | |
|---|---|---|
| 53-34810 | 9/1978 | Japan . |
| 54-14732 | 6/1979 | Japan . |
| 57-21055 | 5/1982 | Japan . |
| 59-12165 | 1/1984 | Japan . |
| 59-24628 | 6/1984 | Japan . |
| 59-36150 | 10/1984 | Japan . |
| 59-52627 | 12/1984 | Japan . |
| 59-226279 | 12/1984 | Japan . |
| 60-33745 | 10/1985 | Japan . |

*Primary Examiner*—Raymond A. Nelli
*Attorney, Agent, or Firm*—Armstrong, Nikaido, Marmelstein, Kubovcik & Murray

[57] ABSTRACT

According to the present invention there is provided an ignition system having a direct current source, a primary voltage stabilizing power source for the generation of a stabilized voltage from the direct current source, a high-tension transformer which receives the voltage from the primary voltage stabilizing power source and applies a high voltage developed on its secondary side to a discharge load, and a switching element for controlling the primary current in the transformer. At least two of those components are integrally connected, or means for detecting an abnormal condition of the direct current source is disposed within the case containing the primary voltage stabilizing power source, whereby connection or insulation between components can be done easily and there are attained simplification of the assembling work, reduction of noise and improvement of maintainability.

3 Claims, 3 Drawing Sheets

INGITION SYSTEM

BACKGROUND OF THE INVENTION

The present invention relates to an ignition system and more particularly to an ignition system for use in an internal combustion engine.

In a conventional ignition system in an internal combustion engine, high-tension pulses are distributed to ignition plugs by means of a distributor having mechanical contacts. Consequently, the path of wiring becomes longer, thus causing the problem of occurrence of noise, so it has heretofore been necessary to pay ample attention to the insulation of each wiring.

On the other hand, electronic distribution type ignition systems not using a distributor having such mechanical contacts have recently been adopted. An example is one using a capacitor discharge ignition (also called CDI) system, for which it is necessary to use a high-tension transformer for supplying a high voltage to ignition plugs of an internal combustion engine and a power source to supply a primary voltage for the high-tension transformer. The primary voltage supplying power source is composed of a power source such as a battery and a primary voltage stabilizing power source for the generation of a stabilized voltage from the former power source (each constituent part is defined herein as "component"). According to the prior art, these components are arranged separately and connected together through wiring.

Consequently, the system size is increased, and since the length of wiring between components becomes longer, there arises a noise trouble. Further, the separate arrangement of components requires insulation between components and it takes time to effect connection between components.

Additionally, since detecting means for detecting an abnormal condition of a battery or a generator used in an automobile or the like also has heretofore been provided separately from the foregoing components, it has not been easy to effect maintenance and inspection.

SUMMARY OF THE INVENTION

It is a first object of the present invention to provide an ignition system which has attained easier connection and insulation between components, simplification of the assembling work and reduction of noise by giving some consideration to the arrangement of the components.

It is a second object of the present invention to provide an ignition system wherein means for detecting a trouble of a battery as a DC source of the ignition system or a generator is mounted within any of the components to thereby improve maintainability.

According to the present invention, in order to achieve the above first object, there is provided an ignition system comprising a DC source, a primary voltage stabilizing power source for the generation of a stabilized voltage from the said DC source, a high-tension transformer which receives voltage from the primary voltage stabilizing power source and applies a high voltage developed on its secondary side to a discharge load, and a switching circuit for controlling the primary current in the high-tension transformer, a plurality of these components being integrally connected within an insulating case.

According to the present invention, in order to achieve the above second object, there is provided the aforementioned ignition system, wherein a power source trouble detecting means is disposed within the case of the primary voltage stabilizing power source.

DESCRIPTION OF THE PREFERRED EMBODIMENTS

Ignition systems embodying the present invention will be described hereinunder with reference to the accompanying drawings.

Figure 1:
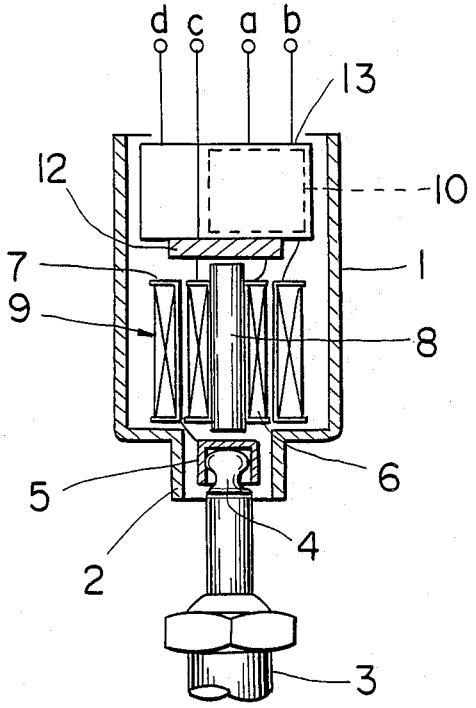
FIG. 1 is a sectional view showing the structure of a principal portion of an ignition system according to an embodiment of the present invention.
Figure 2:
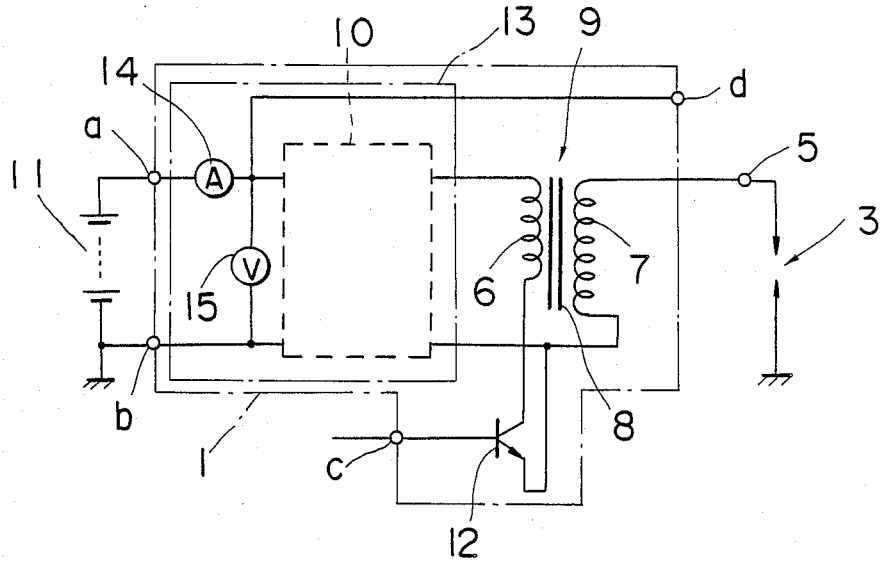
FIG. 2 is an equivalent circuit diagram of FIG. 1.

In FIGS. 1 and 2, the reference numeral 1 denotes a cylindrical insulating case, the lower portion of which is reduced in diameter to form a small-diameter portion 2. Within the small-diameter portion 2 is disposed a cap-like connector 5 which is directly fitted on a terminal 4 of an ignition plug (discharge load) 3 of an internal combustion engine. In the lower part of a large-diameter portion of the case is disposed a high-tension transformer comprising a low-tension coil (primary coil) 6, a high-tension coil (secondary coil) 7 and a magnetic core 8 for magnetic coupling. Disposed above the high-tension transformer 9 is a power source case 13 containing a primary voltage stabilizing power source 10. The primary voltage stabilizing power source 10 is constituted by a DC-DC converter (also referred to simply as "converter" hereinafter) which steps up an input voltage provided from a battery 11 (e.g. DC 12V) as a DC power source or a generator and produces a DC output voltage above 100V and below 1,000V.

As shown in FIG. 2, input terminals (leader lines) a and b of the converter 10 are connected to the battery 11 (or generator) and an output voltage of the converter 10 is connected to one end of the low-tension coil 6. The other end of the coil 6 is connected to a switching element 12 such as a transistor. One end of the high-tension coil 7 is connected to the connector 5.

The high-tension transformer 9 and the converter 10 may be fixed to the case 1 using such means as, for example, molding of resin.

Current detecting means 14 and voltage detecting means 15 are disposed within the power source case 13 and there is provided a detection terminal d. These detecting means are constructed so that they can detect overcharge or voltage drop of the battery 11 or a trouble of the generator in an early stage. As the current and voltage detecting means, in addition to an indicating instrument there may be adopted one which indicates a trouble using the light of a light emitting diode or a lamp, or one which indicates a trouble using alarm sound. Further, the detecting means may be given a function for protecting the battery or the generator.

Figure 5:
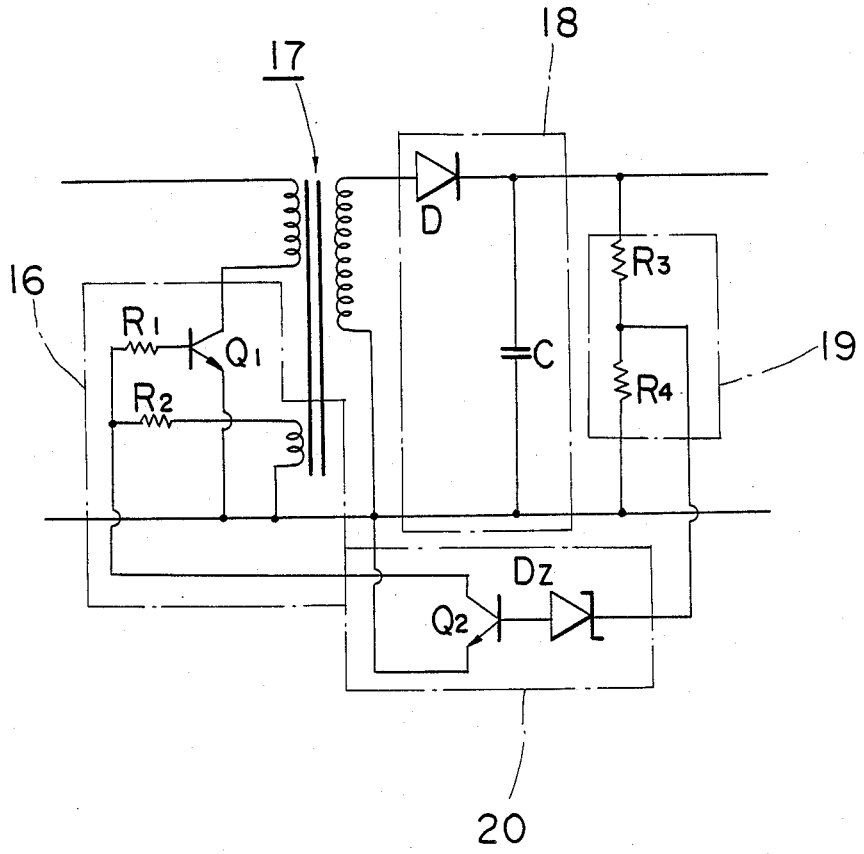
FIG. 5 is a circuit diagram of a primary voltage stabilizing power source.

The converter 10 is of such a circuit configuration as shown in FIG. 5. It comprises a driver circuit 16, a transformer 17 which is driven by the driver circuit 16, a rectifying and smoothing circuit 18 for rectifying and smoothing the secondary voltage of the transformer, an output voltage detecting means 19, and a control circuit 20 for controlling the driver circuit 16 through feedback of a detected output voltage. The driver circuit 16 comprises a transistor $Q_1$, resistors $R_1$ and $R_2$, and a self-excited winding. The rectifying and smoothing circuit 18 comprises a diode D and a capacitor C. The voltage detecting means 19 comprises two resistors $R_3$ and $R_4$, and the control circuit 20 comprises a Zener diode $D_z$ and a transistor $Q_2$.

In the above embodiment, by fitting the cap-like connector 5 in the lower portion of the case 1 onto the ignition plug 3, not only it is possible to effect electrical connection in a simple manner but also mechanically the case 1 can be rendered integral with the ignition plug 3, thereby affording an independent structure.

According to the ignition system of the invention, as set forth above, a high-tension transformer for supplying a high voltage to ignition plugs of an internal combustion engine, a primary voltage stabilizing power source for the high-tension transformer, and a switching circuit for driving the high-tension transformer, are made integral so it is possible to reduce the size of the system; besides, the above construction is advantageous in point of mounting space because it is not necessary to provide a boosting power source separately. Further, since low-tension wiring is sufficient for the ignition plugs, it is easy to effect wiring and there is no fear of noise.

Additionally, since detecting means are disposed within the power source case, it is possible to detect a trouble of the battery, etc. in an early stage and it is also possible to improve maintainability.

An ignition system according to another embodiment of the present invention will be described below with reference to FIGS. 3 and 4.

Figure 3:
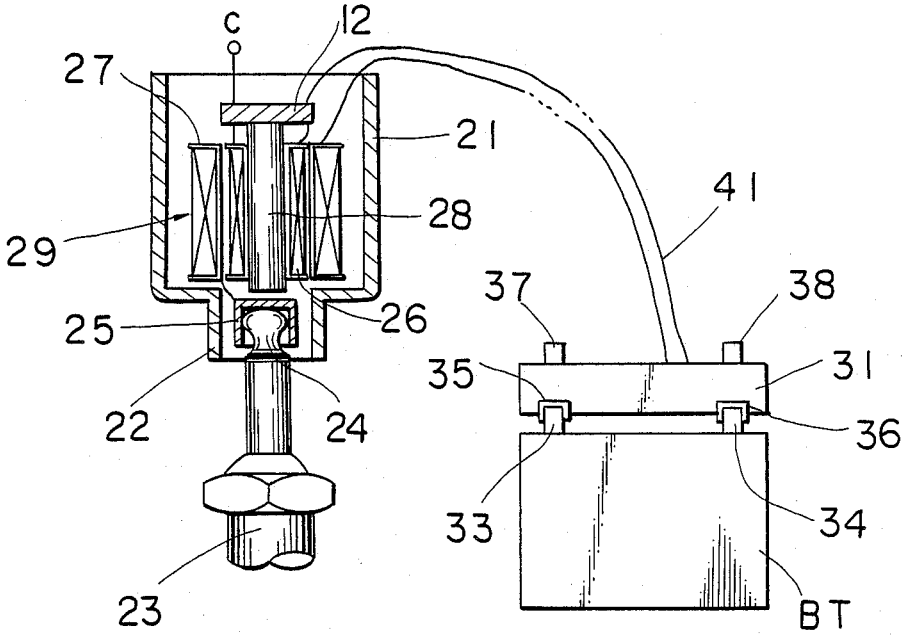
FIG. 3 is a sectional view of a principal portion of an ignition system according to another embodiment of the present invention.
Figure 4:
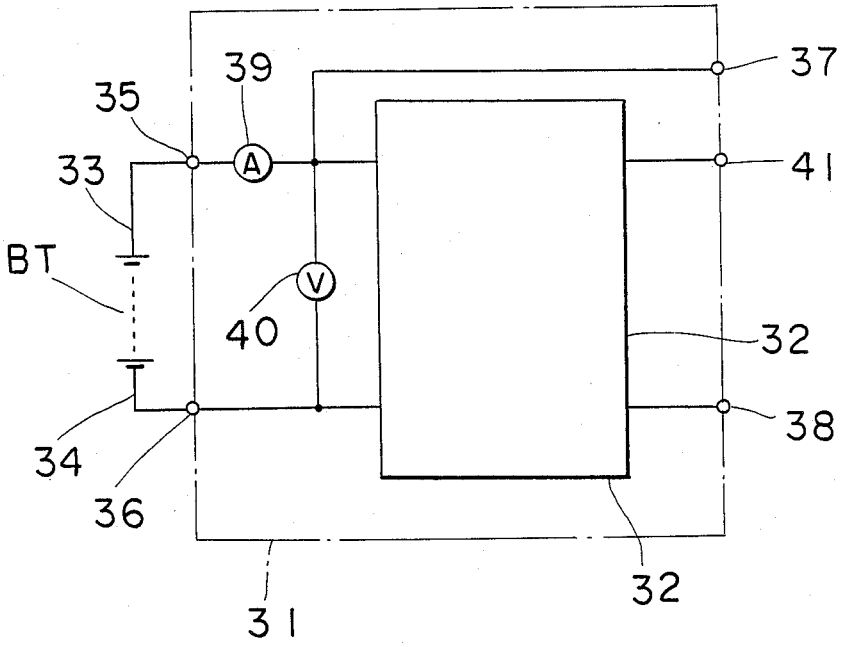
FIG. 4 is an equivalent circuit diagram of a part of FIG. 3.

In FIG. 3, insulating case 21, its small-diameter portion 22, ignition plug 23, its terminal 24, connector 25, low-tension coil 26, high-tension coil 27, magnetic core 28 and high-tension transformer 29 correspond in both structure and arrangement to the components shown in FIG. 1. This embodiment is different from the embodiment of FIG. 1 in that a battery BT and an insulating case 31 connected on top of the battery BT and containing a DC-DC converter are separately provided. The switching element 12 is mounted on top of the transformer 29 disposed within the insulating case 21.

The relation between the battery BT and the case 31 will now be explained with reference also to the equivalent circuit of FIG. 4.

A DC-DC converter 32 as a power source for stepping up a battery voltage (e.g. DC 12V) to a DC voltage of several hundred volts or so is disposed within the insulating case 31 which is in the shape of a flat rectangular parallelopiped suitable for resting directly on the battery of an automobile or the like. At the bottom of the insulating case 31 are disposed power incoming terminals or connectors 35 and 36 directly fitted and connected onto terminals 33 and 34 of the battery BT. On the upper surface of the insulating case 31 are provided a battery voltage terminal 37 for outputting the battery voltage directly as well as an earth terminal 38. Between the power incoming terminal 35 and the terminal 37 is inserted a current detecting means 39, e.g. ammeter, while a battery voltage detecting means 40, e.g. voltmeter, is connected to the input side of the DC converter 32. Both components are mounted in the case 31. An output voltage of the DC-DC converter is provided to an output terminal 41.

In use, the ignition system of this embodiment is placed directly on the battery BT and is directly connected to the battery terminals 33 and 34 through the power incoming terminals 35 and 36 provided at the bottom of the case.

According to the above construction of this embodiment, the insulating case 31 containing the DC-DC converter 32 can be placed directly on the battery BT so the DC-DC converter 32 serving as a component of the ignition system can be mounted to an automobile or the like in an extremely easy manner, thus permitting effective utilization of space. Further, since the current detecting means 39 and the voltage detecting means 40 are provided within the case 31, troubles such as overcharge or voltage drop of the battery BT or failure of the battery can be detected in an early stage, thus permitting improvement of maintainability.

As the current and voltage detecting means, in addition to an indicating instrument there may be adopted one which indicates a trouble using the light of a light emitting diode or a lamp, or one which indicates a trouble using alarm sound. Further, the detecting means may be given a function for protecting the battery or the generator.

As set forth above, the ignition system of the invention is provided with a power source using a battery or generator as an input source for supplying a DC voltage to ignition plugs or a controller in an internal combustion engine, and the battery or generator trouble detecting means or the battery or generator protecting means is disposed within the same case as that for the said power source. Consequently, troubles such as overcharge or voltage drop of the battery BT or failure of the generator can be detected in an early stage and it is possible to attain improvement of maintainability. Further, since the construction permits the case to rest directly on the battery, mounting can be done easily and it is possible to attain effective utilization of space.

We claim:

1. An ignition system including:

a direct current source;

a primary voltage stabilizing power source for the generation of a stabilized voltage from said direct current source;

a high-tension transformer which receives the voltage from said primary voltage stabilizing power source and applies a high voltage developed on its secondary side to a discharge load; and a switching element for controlling the primary current in said transformer, wherein a combination of said transformer and said switching element, or a combination of said transformer, said switching element and said primary voltage stabilizing power source, is integrally disposed within a case.

2. An ignition system according to claim 1, wherein said primary voltage stabilizing power source is disposed within a case and is placed and connected onto said direct current source through a connector attached to the case.

3. An ignition system according to claim 2, wherein a trouble detecting means for detecting an abnormal condition of said direct current source is disposed within the case of said primary voltage stabilizing power source.

* * * * *